US009839994B1

(12) United States Patent
Callwood et al.

(10) Patent No.: US 9,839,994 B1
(45) Date of Patent: Dec. 12, 2017

(54) RAZOR CONDITIONING SYSTEM

(71) Applicants: Alberto R. Callwood, Oldsmar, FL (US); Sandy B. Callwood, Oldsmar, FL (US)

(72) Inventors: Alberto R. Callwood, Oldsmar, FL (US); Sandy B. Callwood, Oldsmar, FL (US)

( * ) Notice: Subject to any disclaimer, the term of this patent is extended or adjusted under 35 U.S.C. 154(b) by 138 days.

(21) Appl. No.: 15/067,629

(22) Filed: Mar. 11, 2016

Related U.S. Application Data

(60) Provisional application No. 62/132,678, filed on Mar. 13, 2015.

(51) Int. Cl.
*B24D 15/08* (2006.01)
*B26B 21/40* (2006.01)
*A45D 27/48* (2006.01)

(52) U.S. Cl.
CPC ..... *B24D 15/088* (2013.01); *A45D 27/48* (2013.01); *B26B 21/40* (2013.01)

(58) Field of Classification Search
CPC ..... B24D 15/088; A45D 27/48; B26B 21/40; B24B 3/48; B24B 37/345; B24B 37/04; B24B 37/005
USPC ..... 451/67, 73
See application file for complete search history.

(56) References Cited

U.S. PATENT DOCUMENTS 1,485,350 A * 2/1924 Shepard ..... B24D 15/088 76/81.1
1,517,909 A * 12/1924 King ..... B24B 3/48 451/194
1,594,827 A * 8/1926 Fix ..... B24B 3/48 451/196
1,736,510 A * 11/1929 Skelley ..... B24D 15/088 132/292
1,937,281 A * 11/1933 Levine ..... B24D 15/088 451/556
2,246,927 A * 6/1941 Schalow ..... B24D 15/088 451/371
2,331,486 A * 10/1943 Loeffler ..... B24D 15/088 451/556
2,343,981 A * 3/1944 King ..... B24D 15/088 451/324
2,347,246 A * 4/1944 Barrett ..... B24D 15/088 451/556

* cited by examiner

*Primary Examiner* — George Nguyen

(57) ABSTRACT

A housing interiorly forms an upper chamber and a lower chamber. An upper opening in the front face of the housing provides access to the upper chamber. A lower opening in the front face provides access to the lower chamber. An upper cover is removably positionable in the upper opening. A lower cover is removably positionable in the lower opening. A razor head with razor blades is removably received by an upper holder and by a lower holder. An ultrasonic motor in the upper chamber vibrates sanitizing fluid. A sharpening assembly contacts and sharpens the razors of the razor head in the lower chamber. A direct current motor in the lower chamber drives the sharpening assembly.

4 Claims, 3 Drawing Sheets

RAZOR CONDITIONING SYSTEM

RELATED APPLICATION

This application is based upon and claims the benefit of Provisional Application No. 62/132,678 filed Mar. 13, 2015, the subject matter of which is incorporated herein by reference.

BACKGROUND OF THE INVENTION

Field of the Invention

The present invention relates to a razor conditioning system and more particularly pertains to cleaning razor blades, drying the razor blades, and sharpening the cleaned razor blades in a safe, convenient, and economical manner.

Description of the Prior Art

The use of razor cleaning and sharpening systems of known designs and configurations is known in the prior art. More specifically, razor cleaning and sharpening systems of known designs and configurations previously devised and utilized for the purpose of cleaning and sharpening razors are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, the aforementioned patent do not describe a razor conditioning system that allows for cleaning razor blade, drying the razor blades, and sharpening the cleaned razor blades in a safe, convenient, and economical manner.

In this respect, the razor conditioning system according to the present invention substantially departs from the conventional concepts and designs of the prior art, and in doing so provides an apparatus primarily developed for the purpose of cleaning razor blades, drying the razor blades, and sharpening the cleaned razor blades in a safe, convenient, and economical manner.

Therefore, it can be appreciated that there exists a continuing need for a new and improved razor conditioning system which can be used for cleaning razor blades, drying the razor blades, and sharpening the cleaned razor blades in a safe, convenient, and economical manner. In this regard, the present invention substantially fulfills this need.

SUMMARY OF THE INVENTION

In view of the disadvantages inherent in the known types of razor cleaning and sharpening systems of known designs and configurations now present in the prior art, the present invention provides an improved razor conditioning system. As such, the general purpose of the present invention, which will be described subsequently in greater detail, is to provide a new and improved razor conditioning system and method which has all the advantages of the prior art and none of the disadvantages.

In a broad context, to attain this, the present invention essentially comprises a housing interiorly forming an upper chamber and a lower chamber. An upper opening in the front face of the housing provides access to the upper chamber. A lower opening in the front face provides access to the lower chamber. An upper cover is removably positionable in the upper opening. A lower cover is removably positionable in the lower opening. A razor head with razor blades is removably received by an upper holder and by a lower holder. An ultrasonic motor is provided in the upper chamber to vibrate sanitizing fluid. A sharpening assembly is provided for contacting and sharpening the razors of the razor head in the lower chamber. A direct current motor is provided in the lower chamber to drive the sharpening assembly. Such components are individually configured and correlated with respect to each other so as to attain the desired objective.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including such equivalent constructions insofar as they do not depart from the spirit and scope of the present invention.

It is therefore an object of the present invention to provide a new and improved razor conditioning system which has all of the advantages of the prior art razor cleaning and sharpening systems of known designs and configurations and none of the disadvantages.

It is another object of the present invention to provide a new and improved razor conditioning system which may be easily and efficiently manufactured and marketed.

It is further object of the present invention to provide a new and improved razor conditioning system which is of durable and reliable constructions.

An even further object of the present invention is to provide a new and improved razor conditioning system which is susceptible of a low cost of manufacture with regard to both materials and labor, and which accordingly is then susceptible of low prices of sale to the consuming public, thereby making such razor conditioning system economically available to the buying public.

Lastly, it is an object of the present invention to provide a razor conditioning system for cleaning razor blades and sharpening the cleaned razor blades in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

The same reference numerals refer to the same parts throughout the various Figures.

DESCRIPTION OF THE PREFERRED EMBODIMENT

Figure 1:
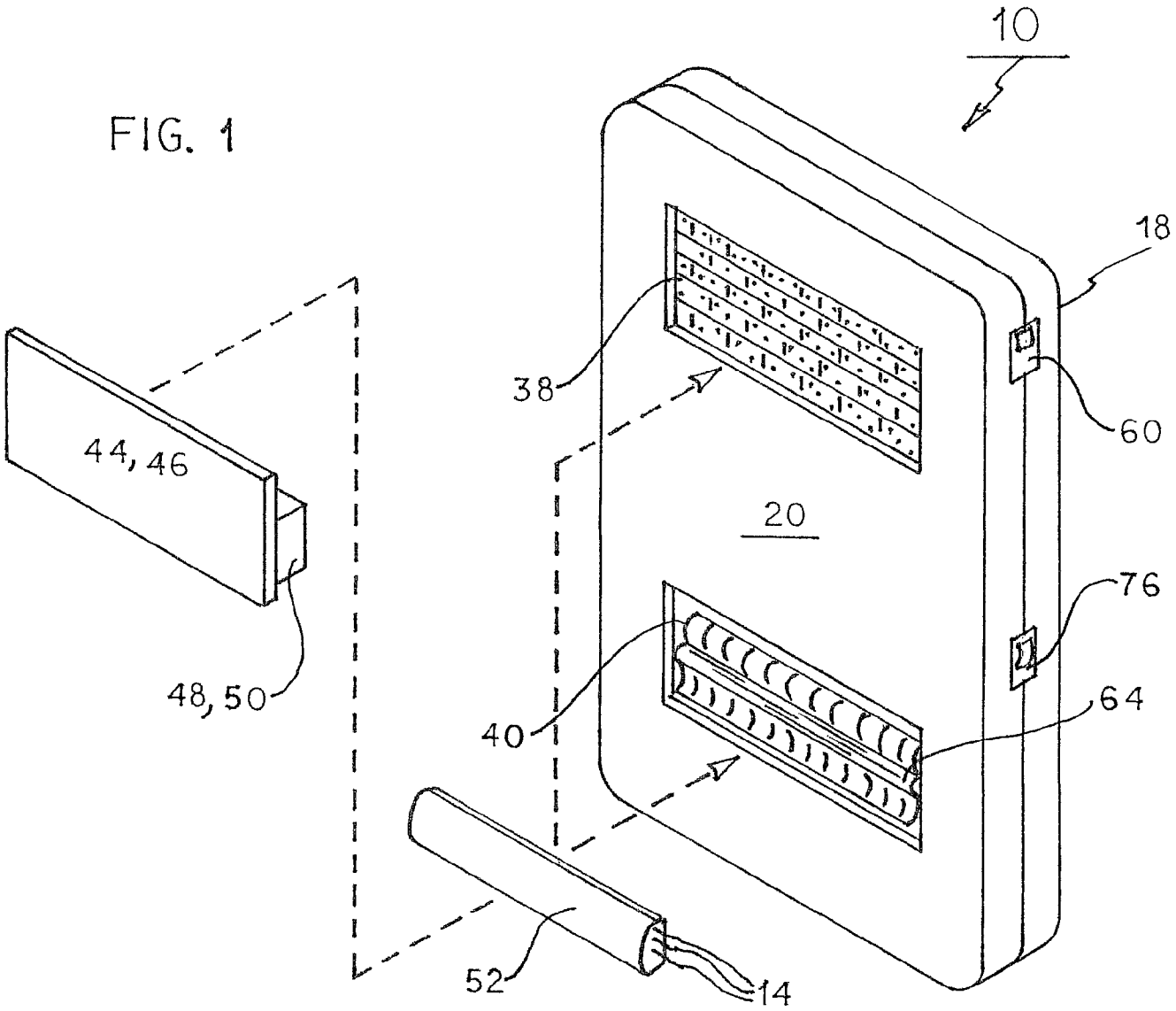
FIG. 1 is an exploded perspective illustration of a razor conditioning system constructed in accordance with the principles of the present invention.
Figure 3:
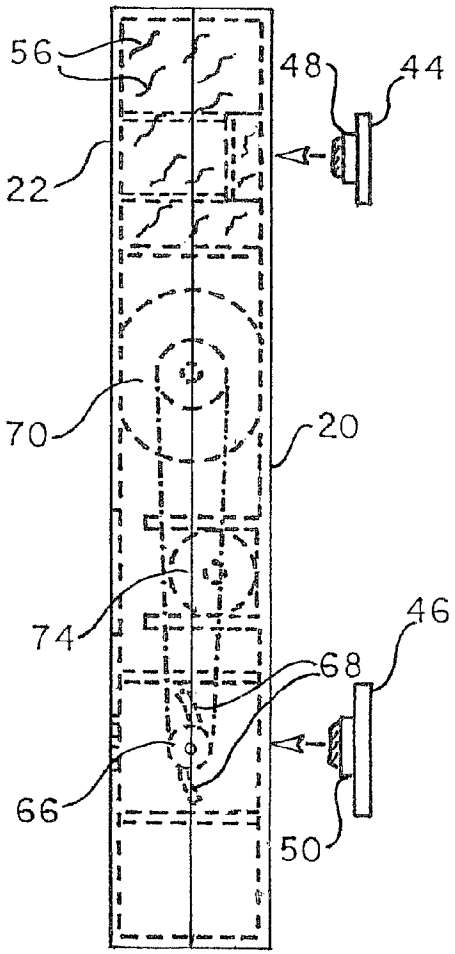
FIG. 3 is an exploded left side elevational view taken at line 3-3 of FIG. 2.
Figure 2:
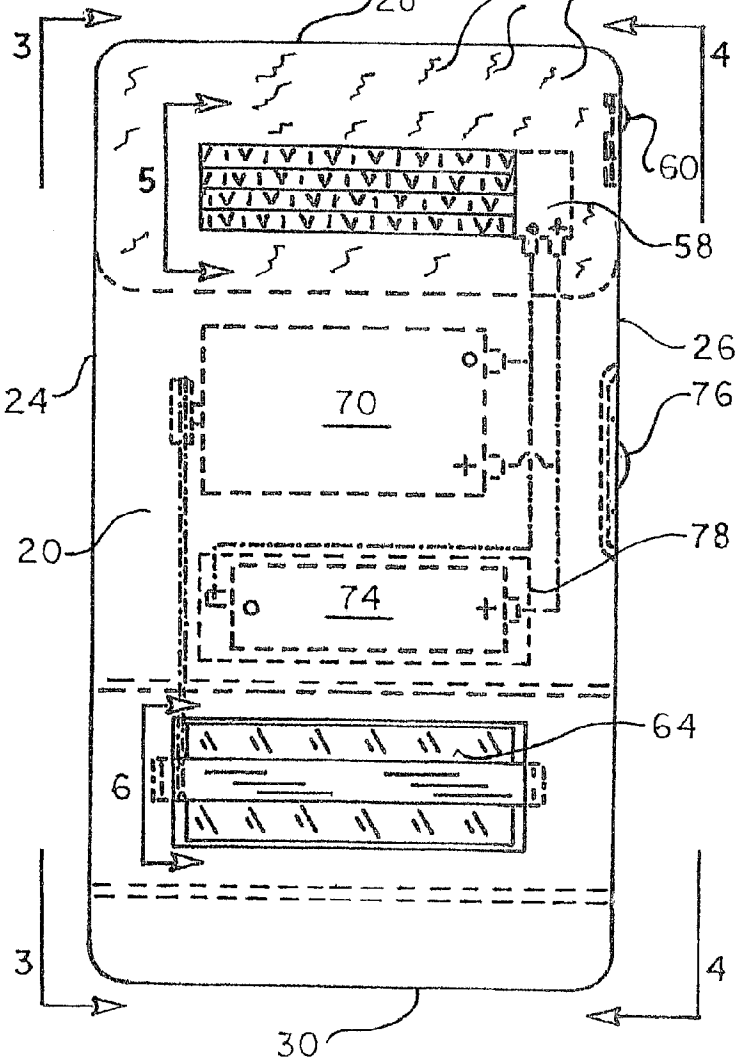
FIG. 2 is a front elevational view of the system shown in FIG. 1.
Figure 5:
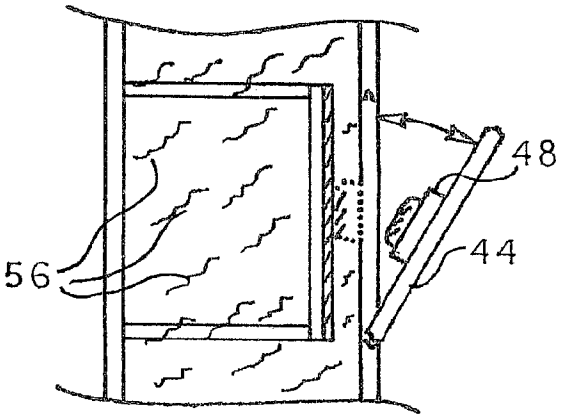
FIG. 5 is an enlarged illustration of the upper chamber for cleaning the razor.
Figure 6:
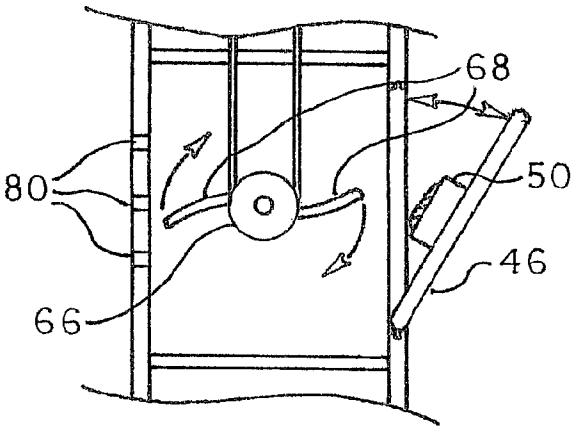
FIG. 6 is an enlarged illustration of the lower chamber for sharpening the razor.
Figure 4:
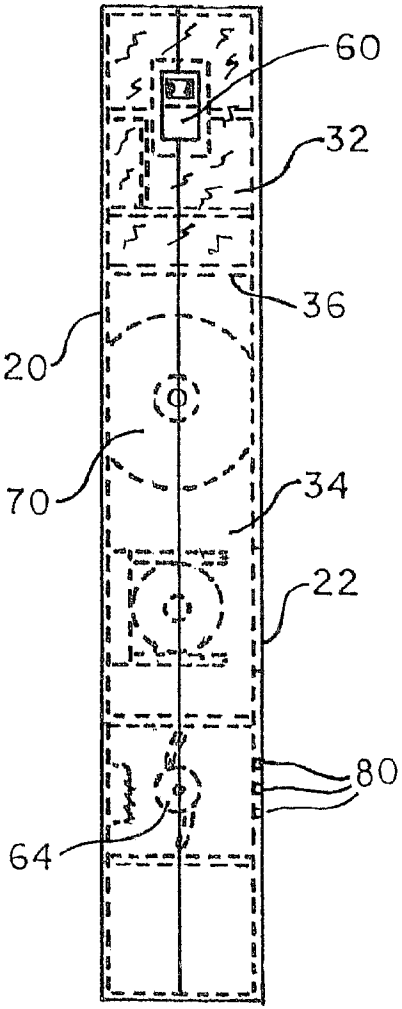
FIG. 4 is an exploded right side elevational view taken at line 4-4 of FIG. 2.

With reference now to the drawings, and in particular to FIG. 1 thereof, the preferred embodiment of the new and improved razor conditioning system embodying the principles and concepts of the present invention and generally designated by the reference numeral 10 will be described.

The present invention, the razor conditioning system 10 is comprised of a plurality of components. In their broadest context such include a housing, an upper cover, a lower cover, a razor head, an ultrasonic motor, a direct current motor, and a sharpening assembly. Such components are individually configured and correlated with respect to each other so as to attain the desired objective.

In the preferred embodiment of the razor conditioning system 10, is for cleaning razor blades 14, for drying the razor blades, and for sharpening the cleaned razor blades. First provided are razor blades 14. Next a housing 18 is provided. The housing is formed in a rectilinear configuration. The housing has a front face 20, a rear face 22, a left side face 24, a right side face 26, a top face 28, and a bottom face 30. The housing interiorly forms an upper chamber 32 and a lower chamber 34. A wall 36 separates the upper chamber and the lower chamber. An upper opening 38 in a rectangular shape is formed in the front face providing access to the upper chamber. A lower opening 40 in a rectangular shape is formed in the front face providing access to the lower chamber.

Next provided is an upper cover 44 in a rectangular configuration. The upper cover is removably positionable in the upper opening. Next provided is a lower cover 46 in a rectangular configuration. The lower cover is removably positionable in the lower opening. The upper cover and the lower cover are similarly configured with an exterior face and an interior face. An upper holder 48 is secured to the interior face of the upper cover. A lower holder 50 is secured to the interior face of the lower cover.

A razor head 52 is next provided. The razor head has a plurality of razor blades 14 adapted to be cleaned and sharpened after each use. The razor head is removably received by the upper holder and removably received by the lower holder.

Next provided is a sanitizing fluid 56 in the upper chamber. An ultrasonic motor 58 in the upper chamber is provided to vibrate the sanitizing fluid to clean the razors of the razor head in the upper chamber. A fluid hole 60 in the right side face is provided for adding sanitizing fluid to the upper chamber and for removing sanitizing fluid from the upper chamber.

A sharpening assembly 64 is next provided. The sharpening assembly includes a roller 66 rotatably mounted on the lower chamber adjacent to the lower opening. Two leather strops 68 are secured to the roller for contacting and sharpening the razors of the razor head in the lower chamber. Next, a direct current motor 70 is provided in the lower chamber to drive the roller and the two leather strops.

Lastly, a battery 74 is provided in the lower chamber between the upper opening and the lower opening. Shown is a conventional panel 78 in the rear face for accessing the battery for battery replacement purposes. The battery is coupled to the ultrasonic motor and the direct current motor. An OFF/ON switch 76 in the right side face for activating and inactivating the ultrasonic motor and the direct current motor. A plurality of holes 80 extend through the housing adjacent to the lower chamber for cooling purposes during operation and use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A razor conditioning system comprising:

a housing interiorly forming an upper chamber and a lower chamber, an upper opening in the front face providing access to the upper chamber, a lower opening in the front face providing access to the lower chamber;

an upper cover removably positionable in the upper opening, a lower cover removably positionable in the lower opening, an upper holder secured to the upper cover, a lower holder secured to the lower cover;

a razor head with razor blades removably received by the upper holder and by the lower holder;

an ultrasonic motor in the upper chamber to vibrate sanitizing fluid; and a sharpening assembly for contacting and sharpening the razors of the razor head in the lower chamber, a direct current motor in the lower chamber to drive the sharpening assembly.

2. The system as set forth in claim 1 wherein the sharpening assembly includes a roller rotatably mounted on the lower chamber adjacent to the lower opening, the roller having two leather strops secured to the roller for contacting and sharpening the razors of the razor head in the lower chamber.

3. The system as set forth in claim 2 and further including:

a battery in the lower chamber between the upper opening and the lower opening, the battery coupled to ultrasonic motor and to the direct current motor, an OFF/ON switch on the housing for activating and inactivating the ultrasonic motor and the direct current motor.

4. A razor conditioning system (10) for cleaning razor blades (14), for drying the razor blades, and for sharpening the cleaned razor blades, the system comprising, in combination:

a housing (18) formed in a rectilinear configuration, the housing having a front face (20) and a rear face (22) and a left side face (24) and a right side face 26 and a top face (28) and a bottom face (30), the housing interiorly forming an upper chamber (32) and a lower chamber (34), a wall (36) separating the upper chamber and the lower chamber, an upper opening (38) in a rectangular shape formed in the front face providing access to the upper chamber, a lower opening (40) in a rectangular shape formed in the front face providing access to the lower chamber;

an upper cover (44) in a rectangular configuration removably positionable in the upper opening, a lower cover (46) in a rectangular configuration removably positionable in the lower opening, the upper cover and the lower cover being similarly configured with an exterior face and an interior face, an upper holder (48) secured to the interior face of the upper cover, a lower holder (50) secured to the interior face of the lower cover;

a razor head (52) having a plurality of razor blades (14) adapted to be cleaned and sharpened after each use, the razor head being removably received by the upper holder, the razor head being removably received by the lower holder;

a sanitizing fluid (56) in the upper chamber, an ultrasonic motor 58 in the upper chamber to vibrate the sanitizing fluid to clean the razors of the razor head in the upper chamber, a fluid hole (60) in the right side face for adding sanitizing fluid to the upper chamber and for removing sanitizing fluid from the upper chamber;

a sharpening assembly (64) including a roller (66) rotatably mounted on the lower chamber adjacent to the lower opening, the roller having two leather strops (68) secured to the roller for contacting and sharpening the razors of the razor head in the lower chamber, a direct current motor (70) in the lower chamber to drive the roller and the two leather strops; and a battery (74) in the lower chamber between the upper opening and the lower opening, a conventional panel (78) in the rear face for accessing the battery for battery replacement purposes, the battery coupled to ultrasonic motor and the direct current motor, an OFF/ON switch (76) on the right side face for activating and inactivating the ultrasonic motor and the direct current motor, a plurality of holes (80) extending through the housing adjacent to the lower chamber for cooling purposes during operation and use.

* * * * *